United States Patent [19]

Majesty

[11] Patent Number: 5,058,305

[45] Date of Patent: Oct. 22, 1991

[54] VERSATILE SHOOTING REST

[76] Inventor: Russell F. Majesty, 8 Pintail Rd., Sheridan, Wyo. 82801

[21] Appl. No.: 544,974

[22] Filed: Jun. 28, 1990

[51] Int. Cl.[5] ..... F41A 23/04

[52] U.S. Cl. ..... 42/94

[58] Field of Search ..... 42/94

[56] References Cited

U.S. PATENT DOCUMENTS

| | | | |
|---|---|---|---|
| 613,241 | 11/1898 | Burton | 42/94 |
| 879,052 | 2/1908 | Jeranek | 42/94 |
| 1,298,920 | 4/1919 | Farago | 42/94 |
| 1,375,487 | 4/1921 | Butler et al. | 42/94 |
| 3,225,656 | 12/1965 | Flaherty et al. | 42/94 |
| 3,576,084 | 4/1971 | Anderson, Jr. | 42/94 |
| 4,882,869 | 11/1989 | Webster | 42/94 |

*Primary Examiner*—Charles T. Jordan

*Attorney, Agent, or Firm*—Douglas M. Clarkson

[57] ABSTRACT

A shooting rest is described as having a blade with a sharp point, the blade being attached to a handle with an enlarged butt section and having a curved concave area. A non-marring neoprene lining is affixed to the curved concave area. The enlarged butt section is pivotable about a longitudinal axis of the shooting rest by exerting a force that is adjustable. The pivotable butt section is secured, in one modification that is described, by a washer with protrusions that mesh with recesses. The butt section and the blade are held together in tension by a threaded member. The blade of the shooting rest has a curved concave area with a non-marring neoprene insert, also, so that the shooting rest can be used by affixing it to a vertical surface.

10 Claims, 1 Drawing Sheet

VERSATILE SHOOTING REST

BACKGROUND OF THE INVENTION

The present invention, generally, relates to devices used with firearms, such as rifles, shotguns and handguns, and, more particularly, to devices used to steady a firearm during aiming and discharge.

FIELD OF THE INVENTION

Shooters and those engaged in hunting frequently require the assistance of a device to steady and to balance a firearm during aiming and firing. This type of device is referred to generally as a shooting rest.

A shooting rest is a device which has tended to be cumbersome to transport. In addition, such a shooting rest is useful only under a limited range of field conditions. Bags filled with sand are used frequently but are heavy and impractical to transport, as on a hunting trip, for example.

Monopodes, as a classification of shooting rests, have heretofore provided minimal support, especially when the firearm must be elevated significantly above a supportive surface. Bipods and tripods, while being steadier, are heavier and, therefore, are more difficult to transport.

None of these prior shooting rests provide satisfactory performance under diverse field conditions, nor when a firearm must be held in an elevated position, such as when a shooter is in a standing position, well above a supportive surface.

DESCRIPTION OF THE PRIOR ART

Many different types of shooting rests are already known. For example, U.S. Pat. No. 4,882,869 to John R. Webster, that issued Nov. 28, 1989, discloses a combination rifle rest and animal choke stick with telescoping tubes and a ground spike that doubles as a knife. The Webster apparatus, as disclosed, provides minimal support especially in the standing position when the tubes must be extended fully.

According to Webster, it is not useful to a hunter operating at an elevation well above a supportive ground surface, such as is encountered when shooting from a tree blind. The large size and complexity of setup are a disadvantage also. In addition, the ground spike, which doubles as a knife, must be detached from the shooting rest in order to realize any of the utility inherent with the knife function. Furthermore, the device as disclosed is not suitable for horizontal insertion, such as for insertion into a fence post or a tree.

The device that is disclosed in U.S. Pat. No. 3,576,084 to William B. Anderson, Jr., which issued Apr. 27, 1971, is a monopode shooting rest that is applicable for penetration into the earth but is not useful for insertion into fallen logs, branches, or tree stumps that may be found on a forest floor. The apparatus as disclosed is not particularly well suited for horizontal use, such as for insertion into a fence post or into a tree trunk. It is also somewhat large and difficult to transport.

U.S. Pat. No. 3,225,656 to J. T. Flaherty et al, that issued Dec. 28, 1965, teaches the use of a cradle with a resilient rubber or plastic lining for frictionally engaging the sides of a rifle. As such, it captures the firearm and, therefore, it is limited to those firearms as may be engaged by the cylindrical contour of the cradle.

While the structural arrangements of these prior art devices at first appearance have similarities with the device of the present invention, they differ in material respects. These differences, as will be described in more detail hereinafter, are essential for the effective use of the invention and which admit of the advantages that are not available with the prior devices.

OBJECTS AND SUMMARY OF THE INVENTION

It is an important object of the invention to provide a shooting rest that is easily and conveniently transportable.

It is also an object of the present invention to provide a shooting rest that not only is effective and convenient for ready use but is useful in other respects also.

Briefly, a shooting rest that is constructed in accordance with the principles of the present invention embodies a blade portion formed at one end with a point and at the opposite end with a handle. The handle is formed at its end furthermost from the blade with an enlarged butt with a concave part which is used as a rest during the aiming of a gun.

The above and other objects, advantages and features of the present invention will become more readily apparent from the following detailed description of the presently preferred embodiment as illustrated in the accompanying drawings.

DETAILED DESCRIPTION OF THE INVENTION

Figure 1:
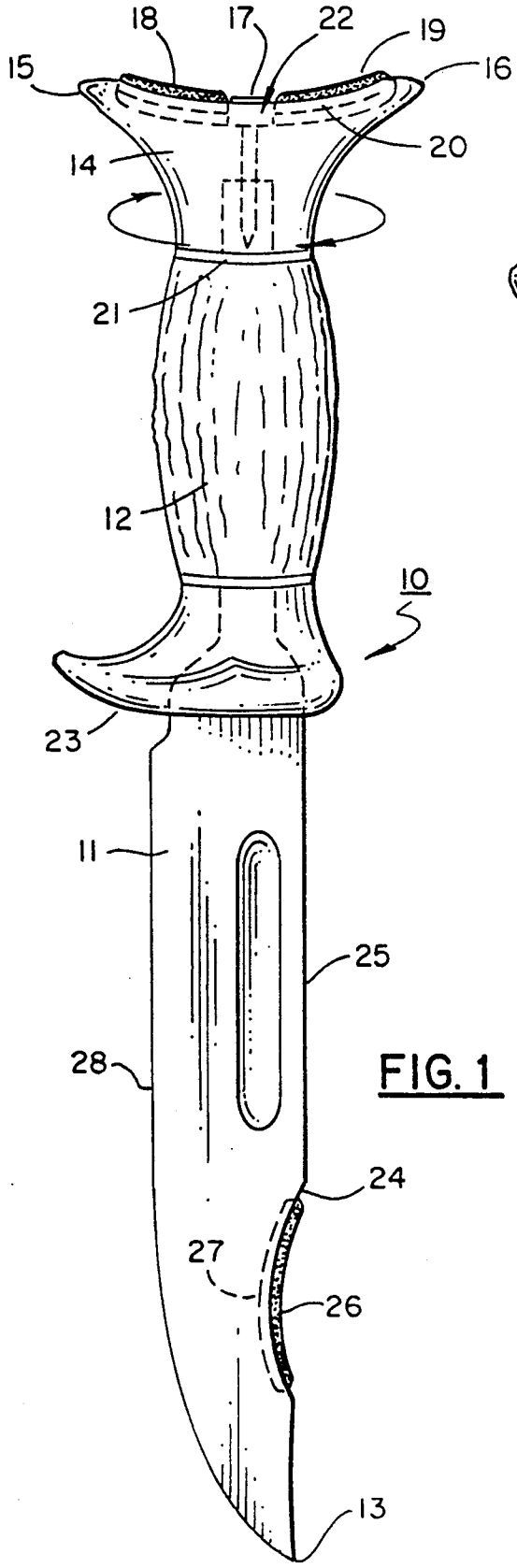
FIG. 1 is a side view of a shooting rest according to the present invention.

Referring now to FIG. 1, the numeral 10 identifies a shooting rest constructed and arranged in accordance with the principles of the present invention. The arrangement of the component parts of the shooting rest 10 features a blade 11 and a handle 12 attached to the blade 11 at the end furthermost from a point 13.

The end of the handle 12 that is furthermost from the blade 11 terminates in an enlarged butt section 14 that is attached pivotally at the end of the handle 12 in a manner to be described in more detail presently. From flared apart ends 15 and 16, the enlarged butt section 14 is generally concave toward the center where a threaded member 17 defines an axis about which the enlarged butt section is pivotable.

The axis that is defined by the threaded member 17 extends throughout the length of the shooting rest 10 and the point 13. By adjusting the tightness of the threaded member 17, the enlarged butt section 14 is more or less easily turned for adjusting its pivotal position.

A non-marring neoprene lining 18 and 19 is affixed by a suitable adhesive in a groove 20 formed in each of the flared apart ends 15 and 16 on the enlarged butt section 14 on each side of the threaded member 17.

The enlarged butt section 14 is pressed against the end of the handle 12 by tightening the threaded member 17, which passes through the center of the enlarged butt section 14 and is threaded into an end of the blade 11 that extends into the handle 12. The threaded member 17 provides a means of anchoring the enlarged butt section 14 to the end of the blade 11 that is within the handle 12 (shown only partially).

Further, the threaded member 17 also provides a means of adjusting the tightness of the enlarged butt section 14 pivotally. Rotating the threaded member 17 changes the force that the enlarged butt section bears against a shim washer 21, which is located between the enlarged butt section 14 and the end of the handle 12.

The force applied against the shim washer 21 is adjusted to permit the enlarged butt section 14 to pivot relative to the handle 12, when the forearm of a gun stock must be moved to track a game animal and a target. The threaded member 17 consists of a round headed screw with a head large enough to be turned readily by a flat edge.

The head of the threaded member 17 is located within a recess 22 formed in the concave surface of the enlarged butt section 14. Thus, the head is sufficiently below the non-marring neoprene linings 18 and 19 to prevent abrasion from occurring to a firearm while still providing easy access for adjusting.

An enlarged area on the handle at the point where the handle 12 joins the blade 11 forms a handstop 23 which prevents the hand of a user from slipping from the handle 12 when driving the point 13 into an object during setting the shooting rest 10 for use, as will be described in more detail hereinafter.

The blade 11 is formed with a tapered flat part, at the end furthermost from the point 13, so that it fits within the handle 12 to prevent the handle from turning relative to the blade 11, regardless of the tension created by either tightening or loosening the threaded member 17. When the threaded member 17 is removed entirely from the end of the blade 11, the enlarged butt section 14 and the handle 12 then may be disassembled and removed apart from the blade 11.

The blade 11 has a curved concave area 24 formed in one edge 25 of the blade 11 a predetermined distance back from the point 13; such as, for example, a distance of approximately one-third the length of the blade 11. This curved concave area 24, in the preferred form of the invention, substantially matches the concave curve on the enlarged butt section 14 between the flared apart ends 15 and 16.

A non-marring neoprene insert 26 is affixed to the curved concave area 24 by a suitable adhesive, similar to the non-marring neoprene inserts 18 and 19. For example, a groove 27 is formed in the curved concave area 24 of the blade 11 so that the adhesive has a place to attach the insert 26. The non-marring neoprene insert 26, in this form of the invention, is wider than the edge 25 of the blade 11, thus providing a suitable non-marring surface.

While, as mentioned hereinabove, the curved concave area 24 is closer to the point 13 than it is to the handle 12, the curved concave area 24 is located sufficiently close to the point 13 to prevent the weight of a firearm from dislodging the point 13 from a support into which it may have been plunged to provide a rest for the firearm. This feature of the invention will be described in more detail presently.

While the shooting rest 10 described hereinabove is extremely portable, since its size is relatively small and it can fit in an ordinary knife sheath, its usefulness is enhanced, according to the invention, by sharpening an edge 28 opposite the edge 25 for it to function as a knife. Clearly, the availability of such a sharp knife edge, as the edge 28, on, for example, a hunting trip renders the shooting rest of the invention unusually useful, while it will be understood by those skilled in the art that such a knife edge is not essential to the invention.

In accordance with the invention, the blade 11 is flat, i.e., a greater distance between the edges 25 and 28 than it is thick, but with the point 13, so that by grasping the handle 12 in the hand and plunging the point 13 into a horizontal surface, the handle 12 is unusually stable in that it will not turn easily when the enlarged butt section 14 is pivoted during tracking.

Likewise, when the point 13 is driven into a vertical surface for use of the surface 25 to steady a firearm, the shooting rest 10, again, will be unusually stable in that it will not turn easily to cause a gun barrel to become marred by contact with the metallic blade 11. Moreover, a wider, blade-like structure will be more stable in flexure when a force is applied on the surface 25.

Figure 2:
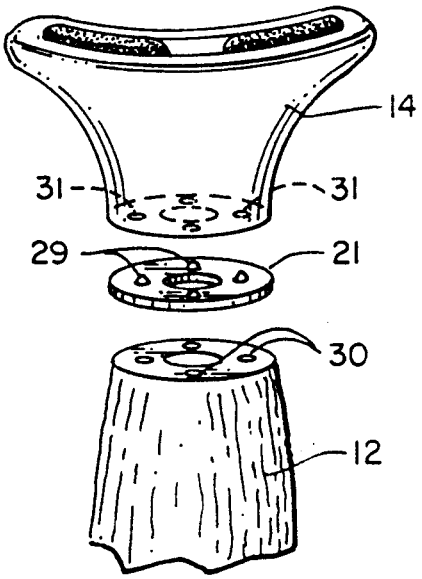
FIG. 2 is an exploded view of an orientation adjustment structure according to a modification of the invention.

Referring now to FIG. 2 of the drawings, the end of the handle 12 furthermost from the blade 11 is shown in an exploded view to illustrate yet another feature to which the shooting rest 10 of the present invention is readily adaptable. In FIG. 2, the shim washer 21 is formed with a plurality of protrusions 29 on both sides. The location of the protrusions 29 match corresponding recesses 30 located in the handle 12 and also with similar recesses 31 located in the enlarged butt section 14.

When it is desired to make pivoting the enlarged butt section 14 relative to the handle 12 increasingly more difficult, the threaded member 17 is tightened more, after first having rotated the enlarged butt section 14 to achieve an alignment of the protrusions 29 with their corresponding recesses 30.

In use, a shooter removes the shooting rest from its protective sheath (not shown) and jabs the sharp point 13 into the ground, or into an appropriate object on the ground, such as a tree stump, or downed section of tree. Either the barrel of a firearm or the hand of the shooter is steadied on the non-marring neoprene lining 18 and 19 of the curved concave part of the enlarged butt section 14.

A shooter, then, would either sit or lie on the ground to use the shooting rest 10 in this manner. By first loosening the threaded member 17, a target is tracked by pivoting the barrel of the firearm or by moving the hand, with the enlarged butt section 14 turning in a like manner. Of course, on those occasions when tracking, involving moving the enlarged butt section 14 slightly in a pivotal manner, is not desired, the threaded member 17 is tightened sufficiently, or the arrangement of FIG. 2 is used, and the curved concave part on the flared ends 15 and 16 becomes relatively fixed in position.

The curved concave area 24 on the blade 11 of the shooting rest 10 is used when a standing tree or structure, such as a wooden post or building, is present. On such occasion, a shooter would plunge the sharp point 13 into the side of a standing tree with the sharp blade edge 28 facing to the ground. The firearm is rested on the neoprene insert 26 and is so steadied. This arrangement is particularly useful when hunting from a tree blind.

Various means for attaching the blade 11 to the handle 12 of an alternate embodiment of the present invention are possible as modifications, in view of the foregoing description. According to one modification, a recess is formed in the side of the handle 12 and the blade 11 is hinged to the handle 12. This arrangement permits the blade 11 to pivot and to swing back for storage in the handle 12 during transporting.

The invention has been shown, described and illustrated in substantial detail with reference to a presently preferred embodiment thereof. It will be understood by those skilled in this art that other and further changes and modifications may be made without departing from the spirit and scope of the invention which is set forth in the claims appended hereto.

What is claimed is:

1. A shooting rest that is light in weight, easily carried, and readily attachable to a horizontal surface or to a vertical surface for steading a firearm during aiming and firing, comprising:

blade means having a predetermined length and having a predetermined width and thickness, with said predetermined width being greater than said thickness, and with a point at one end;

handle means affixed to said blade means at an end of said predetermined length opposite said point, for grasping in the hand of a user to plunge said point into a predetermined surface;

enlarged butt means attached pivotally to said handle means at an end furthermost from said blade means, and having a curved, concave area for resting a firearm during aiming.

2. A shooting rest as defined by claim 1 wherein blade means has two edges, with one of said edges being sharpened to define a cutting edge.

3. A shooting rest as defined by claim 2 wherein said edge opposite said cutting edge having a curved, concave area lined with a predetermined non-marring material, and said area being closer to said point than to said handle.

4. A shooting rest as defined by claim 1 including means to tighten said enlarged butt section against said handle means into a fixed position at a predetermined angle providing one piece rigidity for said enlarged butt section on said handle means.

5. A shooting rest as defined by claim 4 wherein said blade means includes an area reduced in width to fit within said handle means, and said means to tighten includes a threaded means with a head bearing against said enlarged butt section and a plurality of threads threaded into said area of reduced width.

6. A shooting rest as defined by claim 1 wherein said curved, concave area on said enlarged butt section includes a lining of a predetermined non-marring material.

7. A shooting rest as defined by claim 6 including washer means between said handle means and said enlarged, butt section, and threaded means within said curved, concave area to adjust a force to pivot said enlarged butt section relative to said handle means.

8. A shooting rest as defined by claim 7 wherein said predetermined width of said blade means defines two edges, one of said two edges including a curved, concave area a distance closer to said point than to said handle means.

9. A shooting rest as defined by claim 7 wherein said washer means includes at least one protrusion on opposite sides thereof for engaging with matching recesses in said enlarged butt section and said handle means.

10. A shooting rest as defined by claim 9 wherein said blade means includes a portion fitting through said handle means for engagement with threaded means extending through said enlarged butt section.

* * * * *